US005132200A

United States Patent [19]

Fukuda et al.

[11] Patent Number: 5,132,200

[45] Date of Patent: Jul. 21, 1992

[54] ELECTROPHOTOGRAPHIC PHOTORECEPTOR WITH POROUS ANODIZED AL LAYER AND PROCESS FOR PRODUCING THE SAME

[75] Inventors: Yuzuru Fukuda; Shigeru Yagi, both of Kanagawa; Ken Ebihara, Shizuoka; Yasunobu Iwata, Tokyo, all of Japan

[73] Assignee: Fuji Xerox Co., Ltd., Tokyo, Japan

[21] Appl. No.: 586,160

[22] Filed: Sep. 21, 1990

[30] Foreign Application Priority Data

Sep. 25, 1989 [JP] Japan ..... 1-246501

[51] Int. Cl.[5] ..... G03G 5/047

[52] U.S. Cl. ..... 430/131; 430/58; 205/107; 205/201

[58] Field of Search ..... 430/58, 60, 65, 131

[56] References Cited

U.S. PATENT DOCUMENTS 4,369,242 1/1983 Arimilli et al. ..... 430/58
4,634,648 1/1987 Jansen et al. ..... 430/84

FOREIGN PATENT DOCUMENTS 156756 6/1984 Japan ..... 430/58
63051 3/1988 Japan ..... 430/58
224772 9/1989 Japan ..... 430/58

*Primary Examiner*—Roland Martin
*Attorney, Agent, or Firm*—Finnegan, Henderson, Farabow, Garrett and Dunner

[57] ABSTRACT

An electrophotographic photoreceptor is disclosed, comprising at least a substrate having thereon a charge transporting layer and a charge generating layer, wherein said charge transporting layer is a porous anodized aluminum film which is formed by anodizing a substrate at least a surface of which comprises aluminum or an aluminum alloy by using an alternating current having an effective voltage of from 3 to 40 V or an electrical current of alternating waveform having substantially the equal action. And the electrophotographic photoreceptor can be produced by a process comprising subjecting a substrate at least a surface of which comprises aluminum or an aluminum alloy to anodic oxidation in an electrolytic solution by using an alternating current having an effective voltage of from 3 to 40 V or an electrical current of alternating waveform having substantially the equal action to form as a charge transporting layer a porous anodized aluminum film on the substrate and then forming a charge generating layer thereon. The porous anodized aluminum film has sufficient softness to be freed from heat cracks and exhibits satisfactory adhesion to a charge generating layer and excellent mechanical strength.

3 Claims, 1 Drawing Sheet

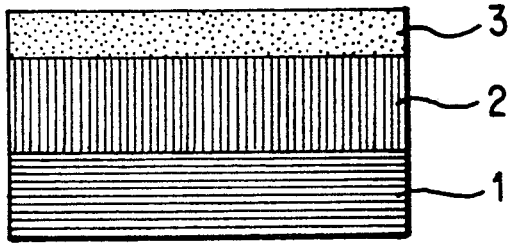
3
2
1

ELECTROPHOTOGRAPHIC PHOTORECEPTOR WITH POROUS ANODIZED AL LAYER AND PROCESS FOR PRODUCING THE SAME

FIELD OF THE INVENTION

This invention relates to an electrophotographic photoreceptor and a process for producing the photoreceptor. More particularly, it relates to an electrophotographic photoreceptor having a function separated type photosensitive layer and to a process for producing the photoreceptor.

BACKGROUND OF THE INVENTION

A so-called function separated type electrophotographic photoreceptor has a photosensitive layer composed of a charge generating layer capable of generating a charge carrier on light irradiation and a charge transporting layer into which the thus generated charge carrier can be efficiently introduced and which is capable of efficiently moving the thus generated charge carrier. In recent years, an amorphous silicon type electrophotographic photoreceptor having a charge generating layer made of amorphous silicon and a charge transporting layer made of an amorphous material which is formed by a plasma CVD method has been attracting attention because it has a possibility of basically improving charging properties and productivity of conventional amorphous silicon type electrophotographic photoreceptors without impairing excellent characteristics possessed by amorphous silicon, such as photosensitivity, high hardness, and heat stability and is therefore promising for obtaining electrical stability on repeated use and a long working life. Attention being paid on these aspects, amorphous silicon type electrophotographic photoreceptors using various charge transporting layers have been proposed. For example, a charge transporting layer which can be used in such an amorphous silicon type electrophotographic photoreceptor of separate function type includes a layer comprising silicon oxide or amorphous carbon formed by a plasma CVD method as disclosed, e.g., in U.S. Pat. No. 4,634,648.

In the above-described amorphous silicon type electrophotographic photoreceptor of separate function type, improvement in chargeability and reduction in dark decay can be brought about by using amorphous silicon as a charge generating layer and using, as a charge transporting layer, a substance having a smaller dielectric constant and higher resistance than the amorphous silicon. However, since a film formed by the above-mentioned plasma CVD method has the same rate of film formation as an amorphous type film and also has a complicated layer structure, the probability of film defects increases to reduce productivity of a photoreceptor, resulting in an extreme increase of production cost.

SUMMARY OF THE INVENTION

Accordingly, an object of this invention is to provide an electrophotographic photoreceptor having an improved charge transporting layer.

That is, one object of the present invention is to provide an electrophotographic photoreceptor having high durability in which a charge transporting layer has satisfactory adhesion and high mechanical strength or hardness and suffers from no heat crack during formation of an amorphous silicon layer, etc. under heating by, for example, a plasma CVD method.

Another object of the present invention is to provide an electrophotographic photoreceptor which has high sensitivity, excellent panchromatic property, high chargeability, reduced dark decay, and reduced residual potential after exposure to light.

A further object of the present invention is to provide an electrophotographic photoreceptor whose charging characteristics are not affected by environmental changes.

A still further object of the present invention is to provide an electrophotographic photoreceptor which provides an image with excellent quality even on repeated use.

A yet further object of the present invention is to provide a process for producing the above-described electrophotographic photoreceptor.

The inventors previously found that an oxide of aluminum has a function as a charge transporting layer. As a result of further investigations, it has now been discovered that a charge transporting layer comprising a porous aluminum oxide film formed by a specific process shows further improvements in physical characteristics, electrophotographic characteristics, and adhesion to a charge generating layer. The present invention has been completed based on this finding.

The present invention relates to an electrophotographic photoreceptor comprising at least a substrate having thereon a charge transporting layer and a charge generating layer, wherein said charge transporting layer is a porous anodized aluminum film which is formed by anodizing a substrate at least a surface of which comprises aluminum or an aluminum alloy by using an alternating current having an effective voltage of from 3 to 40 V or an electrical current of alternating waveform having substantially the equal action.

The electrophotographic photoreceptor of the present invention can be produced by a process comprising subjecting a substrate at least a surface of which comprises aluminum or an aluminum alloy to anodic oxidation in an electrolytic solution by using an alternating current having an effective voltage of from 3 to 40 V or an electrical current of alternating waveform having substantially the equal action to form as a charge transporting layer a porous anodized aluminum film on the substrate and then forming a charge generating layer thereon.

BRIEF DESCRIPTION OF THE DRAWING

FIGURE illustrates a schematic cross section of an embodiment of the electrophotographic photoreceptor according to the present invention, in which numeral 1 is for a substrate, 2 for a porous anodized aluminum film, and 3 for a charge generating layer.

DETAILED DESCRIPTION OF THE INVENTION

FIGURE is a schematic cross section of the electrophotographic photoreceptor according to the present invention which comprises substrate 1, e.g., a pipe having a diameter of from 30 to 200 mm, porous anodized aluminum film 2 formed on substrate 1, and charge generating layer 3 formed on film 2.

The substrate which can be used in the present invention includes an aluminum or aluminum alloy substrate preferably having a thickness of at least 5 μm (particularly at least 20 μm) (hereinafter inclusively referred to as an aluminum substrate), other conductive substrates, and insulating substrates. In using a substrate other than an aluminum substrate, it is preferred to form an aluminum film having a thickness of at least 5 μm (particularly at least 20 μm) on the substrate at least over an area contacting with other layer. The aluminum film can be formed by vacuum evaporation, sputtering, or ion plating. Conductive substrates other than an aluminum substrate include metals, e.g., stainless steel, nickel, chromium, etc., and alloys thereof. Insulating substrates include films or sheets of high polymers, e.g., polyester, polyethylene, polycarbonate, polystyrene, polyamide, polyimide, etc., glass, and ceramics.

An aluminum material for obtaining an anodized aluminum film having satisfactory characteristics is properly chosen from among pure aluminum and aluminum alloy materials, such as Al-Mg, Al-Mg-Si, Al-Mg-Mn, Al-Mn, Al-Cu-Mg, Al-Cu-Ni, Al-Cu, Al-Si, Al-Cu-Zn, Al-Cu-Si, Al-Cu-Mg-Zn, and Al-Mg-Zn. Among these aluminum materials, Al-Mg and Al-Mn are preferred.

The porous anodized aluminum film formed on the aluminum surface of the substrate plays a roll as a charge transporting layer.

The porous anodized aluminum film is formed on the substrate by anodic oxidation as follows. A substrate with the aluminum surface thereof having been polished to have a mirror finish and cut to a desired size is subjected to degreasing to completely remove oily contaminants which had been attached during mechanical processing. Degreasing can be effected with a commercially available degreasing agent for aluminum.

An electrolytic solution is filled in an electrolytic cell made of stainless steel, hard glass, etc. to a prescribed level. The electrolytic solution which can be used is an aqueous solution containing sulfuric acid in a concentration of usually from 50 to 300 g/l, and preferably from 100 to 200 g/l. Pure water to be used as a solvent includes distilled water and ion-exchanged water. In order to prevent corrosion of the anodized aluminum film or production of pinholes, it is particularly preferred to remove impurities, e.g., chlorine, from water.

If the electrolytic solution has a concentration lower than the above-recited range, the rate of film formation would be reduced, or the voltage applied should be increased, which requires excessively large-sized equipment for cooling. If the concentration is higher than the above-recited range, on the other hand, the oxidation product is excessively dissolved, resulting in reduction of rate of film formation.

Then, the substrate having an aluminum surface and a stainless steel plate or an aluminum plate are immersed in the electrolytic solution as an anode and a cathode, respectively, with a given electrode gap therebetween. The electrode gap is appropriately selected from 0.1 to 100 cm. An alternating power source is prepared, and its terminal is connected to each electrode. An alternating voltage is applied to pass electricity through the both electrodes in the electrolytic solution. An alternating current to be used includes a commercial alternating current having a effective voltage of usually from 3 to 40 V, preferably from 8 to 15 V, or a current of alternating waveform having substantially the equal action.

If the effective voltage of the alternating current used is less than 3 V, the rate of film formation becomes too low for obtaining a film having a practical thickness of 5 μm or more. If it exceeds 40 V, a large quantity of heat is generated, making cooling difficult and, also, chemical dissolution takes place with violence, resulting in the failure of forming a uniform anodized film.

The alternating current electrolysis is usually carried out at a temperature of from −5° to 40° C. and preferably from 5° to 30° C. If the temperature is less than 0° C., the rate of film formation becomes low, or the voltage to be applied should be increased. If the temperature is more than 40° C., dissolution of the oxidation product becomes excessive, and the film formation efficiency is reduced as a result.

By electrolysis under these conditions, there is formed a porous anodized aluminum film on the aluminum surface of the substrate. The resulting porous anodized aluminum film obtained by applying an alternating voltage has a smaller porous wall thickness with a larger number of pores and is richer in softness as compared with an anodized aluminum film obtained by applying a direct voltage.

The porous anodized aluminum film has a thickness of usually from 1 to 100 μm, and preferably from 5 to 50 μm. Further, the porous anodized aluminum film preferably has a mean pore size of from 2 to 90 nm and a porosity of from 10 to 70%.

If desired, the porous anodized aluminum film may be subjected to secondary electrolysis to fill the pores thereof with a metal. The metal filled in the pores contributes to charge transporting property as a conductor to improve charge transporting ability of the charge transporting layer. The metal to be filled preferably includes Fe, Ni, Co, Sn, Cu, Zn, and a mixture of two or more thereof. Among these, Ni and Co are preferred.

Filling of the metal into pores by electrodeposition can be carried out in a solution containing a salt of at least one metal selected from the group consisting of Fe, Ni, Co, Sn, Cu, and Zn and an organic or inorganic ion acting as a complexing agent for the metal(s). Particularly, a salt of Ni or Co is preferred as the metal for filling into pores. An ionic solution containing more cathode current components with respect to the sample is used.

The metal salt to be used in the electrolytic solution is not particularly limited as long as it is dissociated into the above-described metal ion. From the economical consideration, sulfates such as ammonium ferric sulfate, nickel sulfate, cobalt sulfate, stannous sulfate, copper sulfate, and zinc sulfate are advantageous.

Substances producing an organic or inorganic ion acting as a complexing agent include those producing an inorganic ion, e.g., boric acid, sulfamic acid, and ammonium sulfate, and those producing an organic ion, e.g., citric acid, tartaric acid, phthalic acid, malonic acid, and malic acid.

Electrolysis is preferably carried out at a liquid temperature of from 0° to 80° C. (particularly from 5° to 60° C.) by using an alternating voltage of from 2 to 100 V (particularly from 5 to 50 V).

The thus formed porous anodized aluminum film is thoroughly washed with water and dried by spontaneous drying or in air at an elevated temperature of at least 80° C.

On the thus prepared porous anodized aluminum film with or without a metal filled in the pores thereof, a charge generating layer is directly formed with intimate contact. A charge generating layer includes a layer of an inorganic substance, e.g., amorphous silicon, selenium, selenium hydride, and selenium-tellurium, formed by plasma CVD, vacuum evaporation, sputtering or the like technique. Additionally included in a charge generating layer is a layer formed by vacuum evaporation of a dye, e.g., phthalocyanine, copper phthalocyanine, Al-phthalocyanine, squaric acid derivatives, and bisazo dyes, or by dip coating of a dispersion of such a dye in a resin. Inter alia, a charge generating layer formed of amorphous silicon or germanium-doped amorphous silicon exhibits excellent mechanical and electrical characteristics.

A case where a charge generating layer is formed by using amorphous silicon is instanced in illustration.

A charge generating layer mainly comprising amorphous silicon can be formed by a process appropriately selected according to the purpose from among known techniques, such as glow discharge decomposition, sputtering, ion plating, and vacuum evaporation. Glow discharge decomposition of silane or a silane type gas by plasma CVD is preferred. According to the plasma CVD method, a film containing an adequate amount of hydrogen which has relatively high dark resistance and high photosensitivity and thus exhibits favorable characteristics as a charge generating layer can be formed.

A plasma CVD method will be illustrated below.

Raw materials for forming an amorphous silicon photosensitive layer mainly comprising silicon include silanes, e.g., monosilane and disilane. If desired, a carrier gas, e.g., hydrogen, helium, argon, and neon, may be used in the formation of a charge generating layer. These starting gases may be doped with diborane ($B_2H_6$), phosphine ($PH_3$), etc. to form a layer containing an impurity element, e.g., boron, phosphorus, etc. For the purpose of increasing photosensitivity, etc., the photosensitive layer may further contain a halogen atom, a carbon atom, an oxygen atom, a nitrogen atom, etc. For the purpose of increasing sensitivity to a longer wavelength region, the layer may furthermore contain germanium, tin, etc.

The charge generating layer which can be preferably used in the present invention mainly comprises silicon and contains preferably from 1 to 40 atom %, and particularly from 5 to 20 atom %, of hydrogen. The thickness of the charge generating layer is in the range of usually from 0.1 to 30 μm, and preferably of from 0.2 to 5 μm.

Conditions of forming a charge generating layer are usually from 0 to 5 GHz, preferably from 3 to 5 GHz, in frequency; usually from $1\times10^{-5}$ to 5 Torr (0.001 to 665 Pa), preferably from $1\times10^{-1}$ to 3 Torr in degree of vacuum on discharging; and usually from 100° to 400° C., preferably from 150° to 300° C. in substrate heating temperature.

If desired, the electrophotographic photoreceptor of the present invention may have a surface protective layer for preventing alteration due to corona ion.

The present invention is now illustrated in greater detail with reference to Examples, but it should be understood that the present invention is not limited thereto.

EXAMPLE 1

An aluminum pipe (diameter: about 120 mm) made of an aluminum alloy containing 4 wt % Mg was immersed in an aqueous solution containing 50 g/l of a degreasing agent ("Fine Cleaner 315" produced by Nihon Parkerizing Co., Ltd.) at 55° C. for 3 minutes, followed by washing with water.

Subsequently, the aluminum pipe was subjected to anodic oxidation in an aqueous solution containing 150 g/l of $H_2SO_4$ and 30 g/l of $Al_2(SO_4)_3.14\text{-}18H_2O$ kept at 15° C. by applying an alternating voltage having an effective value of 12 V via a transformer between the aluminum pipe and an aluminum cathode for 80 minutes to form a 10 μm thick porous anodized aluminum film.

After ultrasonic cleaning in distilled water followed drying at 80° C., the aluminum pipe was placed in a vacuum chamber of a capacitively-coupled type plasma CVD apparatus. The aluminum pipe being maintained at 200° C., 100 wt % silane gas ($SiH_4$), hydrogen-diluted 100 ppm diborane gas ($B_2H_6$), and 100 wt % hydrogen gas ($H_2$) were introduced therein at a rate of 250 ml/min, 3 ml/min, and 250 ml/min, respectively. After the inner pressure of the vacuum chamber was set at 1.5 Torr (200.0 $N/m^2$), a high-frequency electric power of 13.56 MHz was applied to cause glow discharge, and the output of the high-frequency power source was maintained at 350 W. There was thus formed a 2 μm thick charge generating layer comprising so-called i-type amorphous silicon, containing hydrogen and a trace amount of boron, and having high dark resistance.

Positive chargeability of the resulting electrophotographic photoreceptor was measured. When an electric current of 10 μA/cm was passed through the photoreceptor, the initial surface potential immediately after charging was 500 V, and the dark decay rate was 12%/sec. The residual potential after exposure to white light was 125 V, and the half-decay exposure amount (i.e., exposure required for the half decay of the surface potential) was 9 $erg.cm^{-2}$. A ratio of residual potential to initial surface potential, an indication of charge transporting properties, was found to be 0.2. (The practical charge transporting properties are 0.2 or less.)

No crack was observed in the porous anodized aluminum film.

COMPARATIVE EXAMPLE 1

An electrophotographic photoreceptor was prepared in the same manner as in Example 1, except that the porous anodized aluminum film was formed by using a direct current instead of conducting alternating current electrolysis. That is, an electrolytic solution having the same composition as used in Example 1 was employed, and a direct current of 12 V was applied between the aluminum pipe as an anode and an aluminum cathode at 15° C. to form a 20 μm thick porous anodized aluminum film. A charge generating layer was then formed thereon in the same manner as an Example 1 to obtain an electrophotographic photoreceptor.

The resulting photoreceptor was evaluated in the same manner as in Example 1. The results obtained are shown below.

Initial Surface Potential: 540 V
Dark Decay: 10%/sec
Residual Potential: 170 V
Half Decay Exposure Amount: 10 $erg.cm^{-2}$
Charge Transporting Properties: 0.31.

Cracks parallel with the axis of the aluminum pipe were observed in the porous anodized aluminum film.

EXAMPLE 2

On the same aluminum pipe as used in Example 1 was formed a 15 μm thick porous anodized aluminum film in the same manner as in Example 1. After thoroughly washing with distilled water, the aluminum pipe was subjected to secondary electrolysis for electrodeposition (i.e., precipitation due to electrolysis) of a metal. The secondary electrolysis was carried out in an aqueous solution (ph=4.5) containing 30 g/l of $CoSO_4.7$-

$H_2O$, 20 g/l of $H_3BO_3$, and 5 g/l of $(NH_4)_2SO_4$ by applying an alternating current at an effective voltage of 14 V for 3 minutes.

After the aluminum pipe was subjected to ultrasonic cleaning in distilled water and drying at 80° C., a charge generating layer was formed thereon in the same manner as in Example 1.

The resulting electrophotographic photoreceptor was evaluated in the same manner as in Example 1. The results obtained are shown below.

Initial Surface Potential: 430 V
Dark Decay: 14%/sec
Residual Potential: 35 V
Half Decay Exposure Amount: 8 erg.cm$^{-2}$
Charge Transporting Properties: 0.08

No crack was observed in the porous anodized aluminum film.

COMPARATIVE EXAMPLE 2

An electrophotographic photoreceptor was prepared in the same manner as in Example 2, except that the porous anodized aluminum film was formed by using a direct current instead of conducting alternating current electrolysis.

The resulting photoreceptor was evaluated in the same manner as in Example 1. The results obtained are shown below.

Initial Surface Potential: 450 V
Dark Decay: 12%/sec
Residual Potential: 54 V
Half Decay Exposure Amount: 9 erg.cm$^{-2}$
Charge Transporting Properties: 0.12

Cracks parallel with the axis of the pipe were observed in the porous anodized aluminum film.

COMPARATIVE EXAMPLE 3

An electrophotographic photoreceptor was prepared in the same manner as in Example 1, except that the porous anodized aluminum film was formed by using an alternating current at an effective voltage of 2 V. The resulting porous anodized aluminum film had a thickness of 2.5 μm.

The resulting photoreceptor was evaluated in the same manner as in Example 1. As a result, the initial surface potential immediately after charging was as low as 105 V, and thereby the image having the practical density could not be obtained.

COMPARATIVE EXAMPLE 4

An electrophotographic photoreceptor was prepared in the same manner as in Example 1, except that the porous anodized aluminum film was formed by using an alternating current at an effective voltage of 50 V. The liquid temperature rose to 60° due to shortage of cooling capacity. The resulting porous anodized aluminum film had a thickness of 5 μm.

The resulting photoreceptor was evaluated in the same manner as in Example 1. As a result, the initial surface potential immediately after charging was as low as 110 V, and thereby the image having the practical density could not be obtained.

As described above, a charge transporting layer of the electrophotographic photoreceptor according to the present invention which comprises a porous anodized aluminum film formed by alternating current electrolysis has softness and suffers from no cracks. The electrophotographic photoreceptor having such a change transporting layer exhibits high sensitivity, excellent panchromatic property, high chargeability, reduced dark decay, and reduced residual potential after exposure to light. Further, the charging characteristics of the photoreceptor are not affected by environmental changes, and an image of excellent quality can be obtained even on repeated running. Furthermore, the photoreceptor has very excellent adhesion between the charge transporting layer and charge generating layer, and high mechanical strength or hardness with reduced defects. Hence, the electrophotographic photoreceptor of the present invention has excellent durability.

While the invention has been described in detail and with reference to specific embodiments thereof, it will be apparent to one skilled in the art that various changes and modifications can be made therein without departing from the spirit and scope thereof.

What is claimed is:

1. A process for producing an electrophotographic photoreceptor which comprises subjecting a substrate at least a surface of which comprises aluminum or an aluminum alloy to anodic oxidation in an electrolytic solution by using an alternating current having an effective voltage of from 3 to 40 V or an electrical current of alternating waveform having substantially the equal action to form as a charge transporting layer a porous anodized aluminum film on the substrate and then forming a charge generating layer thereon.

2. The process for producing an electrophotographic photoreceptor as claimed in claim 1, wherein said charge generating layer is formed by using amorphous silicon.

3. The process for producing an electrophotographic photoreceptor as claimed in claim 1, wherein said effective voltage is from 8 to 15 V.

* * * * *